US010837297B2

(12) United States Patent
Iwakiri et al.

(10) Patent No.: US 10,837,297 B2
(45) Date of Patent: Nov. 17, 2020

(54) CENTRIFUGAL COMPRESSOR AND TURBOCHARGER

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Isao Tomita, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 104 days.

(21) Appl. No.: 15/779,110

(22) PCT Filed: Dec. 25, 2015

(86) PCT No.: PCT/JP2015/086278
§ 371 (c)(1),
(2) Date: May 25, 2018

(87) PCT Pub. No.: WO2017/109949
PCT Pub. Date: Jun. 29, 2017

(65) Prior Publication Data
US 2018/0347382 A1 Dec. 6, 2018

(51) Int. Cl.
*F01D 9/02* (2006.01)
*F04D 17/10* (2006.01)
(Continued)

(52) U.S. Cl.
CPC ..... *F01D 9/026* (2013.01); *F04D 17/10* (2013.01); *F04D 29/4226* (2013.01);
(Continued)

(58) Field of Classification Search
CPC .... F01D 9/026; F01D 29/422; F04D 29/4226; F04D 29/441; F04D 29/444;
(Continued)

(56) References Cited

U.S. PATENT DOCUMENTS

2010/0178163 A1 7/2010 Dettmann et al.
2015/0108920 A1 4/2015 Simonian et al.
2016/0108921 A1 4/2016 Ishikawa

FOREIGN PATENT DOCUMENTS

CN 105121864 A 12/2015
DE 102013017694 A1 7/2014
(Continued)

OTHER PUBLICATIONS

Office Action dated May 17, 2019 issued in the corresponding European Application No. 15 911 386.9.
(Continued)

*Primary Examiner* — Kenneth Bomberg
*Assistant Examiner* — Jesse M Prager
(74) *Attorney, Agent, or Firm* — Birch, Stewart, Kolasch & Birch, LLP.

(57) ABSTRACT

A centrifugal compressor includes an impeller and a casing, the casing includes a scroll part forming a scroll flow passage and a diffuser part forming a diffuser flow passage. The diffuser part includes: a first diffuser portion belonging to a first angular range in a circumferential direction of the impeller; and a second diffuser portion belonging to a second angular range downstream of the first angular range in a flow direction of the scroll flow passage, of the angular range in the circumferential direction of the impeller, the second diffuser portion having an outer radius R2 which is defined along a reference circle centered at a rotational center of the impeller. An outer radius R1 of the first diffuser portion in the first angular range is smaller than the outer radius R2 of the second diffuser portion in the second angular range.

6 Claims, 11 Drawing Sheets

(51) Int. Cl.

| | |
|---|---|
| ***F04D 29/66*** | (2006.01) |
| ***F04D 29/44*** | (2006.01) |
| ***F04D 29/42*** | (2006.01) |
| ***F04D 29/62*** | (2006.01) |

(52) U.S. Cl.
CPC ..... *F04D 29/441* (2013.01); *F04D 29/444* (2013.01); *F04D 29/624* (2013.01); *F04D 29/667* (2013.01); *F05D 2220/40* (2013.01); *F05D 2250/15* (2013.01); *F05D 2250/25* (2013.01); *F05D 2250/52* (2013.01)

(58) Field of Classification Search
CPC ..... F04D 29/624; F05D 2220/40; F05D 2250/15; F05D 2250/25; F05D 2250/52
See application file for complete search history.

(56) References Cited

FOREIGN PATENT DOCUMENTS

| | | | |
|---|---|---|---|
| JP | 2000-64994 | A | 3/2000 |
| JP | 2010-529358 | A | 8/2010 |
| JP | 5124636 | B2 | 1/2013 |
| WO | WO 2015/0642722 | A1 | 5/2015 |

OTHER PUBLICATIONS

Office Action dated Jun. 17, 2019 issued in the corresponding Chinese Application No. 201580084900.1 with an English Translation.
Extended European Search Report dated Nov. 12, 2018 in corresponding European Application No. 15911386.9.

COMPARATIVE EMBODIMENT

PRESENT EMBODIMENT

CENTRIFUGAL COMPRESSOR AND TURBOCHARGER

TECHNICAL FIELD

The present disclosure relates to a centrifugal compressor and a turbocharger.

BACKGROUND ART

A centrifugal compressor used in a compressor part or the like of a turbocharger for automobiles or ships imparts kinetic energy to a fluid through rotation of an impeller and discharges the fluid outward in the radial direction, thereby achieving a pressure increase by utilizing the centrifugal force.

Such a centrifugal compressor is provided with various features to meet the need to improve the pressure ratio and the efficiency in a wide operational range.

As a prior art, Patent Document 1 discloses a centrifugal compressor for reducing occurrence of pressure pulsation. The centrifugal compressor disclosed in Patent Document 1 includes a spiral-shaped housing and a diffuser, and the radius of the diffuser in a transition region of the spiral-shaped housing or a region where a tongue section is positioned is increased so as to reduce the negative pressure region in the transition region or the region with the tongue section.

CITATION LIST

Patent Literature

Patent Document 1: JP2010-529358A (translation of a PCT application)

SUMMARY

Problems to be Solved

FIG. 10 is a schematic cross-sectional view of a centrifugal compressor according to a comparative embodiment, perpendicular to the rotational shaft of the centrifugal compressor. In the comparative embodiment shown in FIG. 10, the diffuser portion 010 has a circular shape in the axial directional view, and the distance R between the outer peripheral edge 010E of the diffuser portion 010 and the rotational center O of the impeller is constant regardless of the circumferential directional position.

Generally, at the small flow-rate operation point of the centrifugal compressor, the flow inside the scroll flow passage 004 becomes a speed reduction flow from the scroll start 004*a* to the scroll end 004*b* of the scroll flow passage, and the pressure at the scroll start is lower than the pressure at the scroll end. Thus, in the scroll flow passage, a recirculation flow 'fc' from the scroll end to the scroll start is generated at the angular position of the tongue section 012. Such a recirculation flow causes separation as a result of the main flow being drawn into a flow-passage connection part rapidly, which is one of the main causes of generation of high loss.

Furthermore, according to findings of the present inventors, as shown in FIGS. 11 and 12A to 12C, the flow 'fd' from the diffuser outlet 08*a* forms a swirl flow along the flow passage wall of the scroll flow passage 004, and thus, at the scroll start 004*a* of the scroll flow passage formed to have a circular cross section in the comparative example, the flow from the diffuser outlet deflects toward a region Do on the radially outer side of the flow passage cross section of the scroll flow passage (in the example shown in FIGS. 11 and 12A to 12C, the flow from the diffuser outlet is deflected to the region Do at an angular position of θ=0 degree and an angular position of θ=15 degrees, provided that θ is 0 degree at the angular position of the tongue section 12, and θ is an angular position downstream from the angular position of the tongue section 12). Accordingly, at the scroll start in the scroll flow passage, as shown in FIG. 13, the recirculation flow 'fc' enters easily into the region Di on the radially inner side, where the scroll flow passage is not filled with the flow from the diffuser outlet, which increases the flow rate of the recirculation flow and causes an increase in the loss that accompanies the recirculation flow.

While Patent Document 1 discloses a configuration of a centrifugal compressor for reducing occurrence of pressure pulsation, it does not disclose a configuration of a centrifugal compressor for suppressing a recirculation flow in the vicinity of a tongue section.

The present invention was made in view of the above, and an object of the present invention is to provide a centrifugal compressor capable of improving the compressor performance by reducing the loss that accompanies the recirculation flow, and a centrifugal compressor having the same.

Solution to the Problems (1) A centrifugal compressor according to at least one embodiment of the present invention includes an impeller and a casing which accommodates the impeller. The casing includes a scroll part forming a scroll flow passage on a radially outer side of the impeller and a diffuser part forming a diffuser flow passage for supplying the scroll flow passage with compressed air compressed by the impeller. The diffuser part includes: a first diffuser portion belonging to a first angular range including an angular position of a tongue section of the scroll part, of an angular range in a circumferential direction of the impeller; and a second diffuser portion belonging to a second angular range downstream of the first angular range in a flow direction of the scroll flow passage, of the angular range in the circumferential direction of the impeller, the second diffuser portion having an outer radius R2 which is defined along a reference circle centered at a rotational center of the impeller. An outer radius R1 of the first diffuser portion in the first angular range is smaller than the outer radius R2 of the second diffuser portion in the second angular range.

With the above centrifugal compressor (1), the outer radius R1 of the first diffuser portion in the first angular range including the angular position of the tongue section of the scroll flow passage is smaller than the outer radius R2 of the second diffuser portion in the second angular range downstream of the first angular range, and thus it is possible to easily shift the flow-passage cross section of the scroll flow passage in the first angular range from the flow-passage cross section of the scroll flow passage in the second angular range, inward in the radial direction of the impeller. Thus, it is possible to facilitate introduction of the diffuser outlet flow that flows from the diffuser flow passage to the scroll flow passage in the first angular range to the region on the radially inner side (inner side in the radial direction) of the flow-passage cross section on the downstream side.

Accordingly, compared to the comparative embodiment described above (centrifugal compressor in which the outer peripheral edge of the diffuser portion has a circular shape in the axial directional view and the outer radius of the diffuser portion is constant regardless of the circumferential directional position), it is possible to easily position the angular position where the diffuser outlet flow arrives at the region on the radially inner side in the flow-passage cross section at the scroll start in the vicinity of the tongue section of the scroll flow passage (angular position where the mass flow rate of the diffuser outlet flow in the region on the radially inner side reaches some level) closer to the angular position of the tongue section. Accordingly, it is possible to effectively suppress deflection of the flow from the diffuser outlet to the region on the radially outer side at the scroll start of the scroll flow passage.

Thus, compared to the above comparative embodiment, it is more difficult for the recirculation flow to enter the region on the radially inner side in the scroll flow passage, and thereby it is possible to suppress generation of the recirculation flow and to suppress generation of loss that accompanies the recirculation flow. Furthermore, since generation of the recirculation flow is suppressed, it is possible to reduce the flow-passage cross-sectional area of the scroll flow passage required, and to reduce the size of the scroll part.

It is known that a recirculation flow tends to accumulate at the center of the cross section of the scroll flow passage, and at occurrence of surge that limits the operational limit of the compressor at a low air flow side, a reverse flow occurs from the center part of the scroll cross section where the low energy fluid is accumulated. In this regard, with the above embodiment, the outer radius of the first diffuser portion belonging to the first angular range including the angular position of the tongue section is smaller than the outer radius of the second diffuser portion belonging to the second angular range downstream of the first angular range, and thereby generation of the recirculation flow is suppressed, which makes it possible to make the energy distribution uniform in the cross section of the scroll flow passage and to bring about improvement of the surge characteristics (achievement of a wider range).

(2) In some embodiments, in the above centrifugal compressor (1), the scroll part is configured such that a distance Ra between the rotational center of the impeller and a centroid of a flow-passage cross section of the scroll flow passage in the first angular range is smaller than a distance Rb between the rotational center of the impeller and a centroid of a flow-passage cross section of the scroll flow passage in the second angular range.

With the above centrifugal compressor (2), the flow-passage cross section of the scroll flow passage in the first angular range is shifted inward from the flow-passage cross section of the scroll flow passage in the second angular range, in the radial direction of the impeller. Thus, it is possible to facilitate introduction of the diffuser outlet flow that flows from the diffuser flow passage to the scroll flow passage in the first angular range including the angular position of the tongue section to the region on the radially inner side (inner side in the radial direction) of the flow-passage cross section on the downstream side. Accordingly, it is possible to suppress generation of a recirculation flow effectively.

(3) In some embodiments, in the above centrifugal compressor (1) or (2), the outer radius R1 of the first diffuser portion at the angular position of the tongue section in the circumferential direction of the impeller and the outer radius R2 of the second diffuser portion in the second angular range satisfy $0.8R2<R1<R2$.

Generally, when the outer radius of the diffuser portion is reduced (when the diffuser flow passage is short), the reduction amount of the flow velocity in the diffuser flow passage decreases, and the fluid enters the scroll flow passage at a relatively high flow velocity.

In this regard, with the diffuser portion being configured to satisfy $0.8R2<R1<R1$ as described above in (3), it is possible to enhance the efficiency of the centrifugal compressor effectively through reduction of loss that accompanies a recirculation flow, while suppressing influence of an increase in the inflow velocity of the fluid into the scroll flow passage through reduction of the outer radius R1 of the first diffuser portion.

(4) In some embodiments, in the centrifugal compressor according to any one of the above (1) to (3), the first angular range is included in an angular range of from minus 90 to 90 degrees, provided that the angular position of the tongue section in the circumferential direction is zero degree.

With the above centrifugal compressor (4), the outer radius R1 of the first diffuser portion 14 is reduced in the angular range in the vicinity of the tongue section 12 of the scroll flow passage 4 (from minus 90 to 90 degrees), and thereby it is possible to facilitate introduction of the diffuser outlet flow that flows from the diffuser flow passage to the scroll flow passage in the vicinity of the angular position of the tongue section to the region on the radially inner side (inner side in the radial direction) of the flow-passage cross section on the downstream side. Accordingly, it is possible to suppress generation of a recirculation flow effectively.

(5) In some embodiments, in the above centrifugal compressor (4), the first angular range is included in an angular range of from minus 45 to 45 degrees.

With the above centrifugal compressor (5), the outer radius R1 of the first diffuser portion 14 is reduced in the angular range in the vicinity of the tongue section 12 of the scroll flow passage 4 (from minus 40 to 45 degrees), and thereby it is possible to facilitate introduction of the diffuser outlet flow that flows from the diffuser flow passage to the scroll flow passage in the vicinity of the angular position of the tongue section to the region on the radially inner side (inner side in the radial direction) of the flow-passage cross section on the downstream side. Accordingly, it is possible to suppress generation of a recirculation flow effectively.

(6) In some embodiments, in the centrifugal compressor described in any one of the above (1) to (5), the second angular range is an entire angular range in the circumferential direction of the impeller excluding the first angular range.

With the above centrifugal compressor (6), the second diffuser portion having the relatively large outer radius is disposed over the entire angular range excluding the first angular range in the circumferential direction of the impeller (angular range where the outer radius of the diffuser part is less likely to contribute to suppression of a recirculation flow) to give preference to recovery of pressure, and thus it is possible to reduce pressure loss in the scroll flow passage effectively. As described above, the first diffuser portion having the relatively small radius R1 is disposed in the first angular range including the angular position of the tongue section (the angular range that is likely to contribute to suppression of a recirculation flow) and the second diffuser portion having the relatively large outer radius giving priority to pressure recovery is disposed in the second angular range that is less likely to contribute to suppression of a recirculation flow, and thereby it is possible to improve efficiency of the centrifugal compressor effectively.

(7) In some embodiments, in the centrifugal compressor described in any one of the above (1) to (6), an outer peripheral edge of the first diffuser portion has a curved convex shape curved so as to protrude outward in a radial direction of the impeller.

With the above centrifugal compressor (7), the outer radius R1 of the first diffuser portion can be changed gradually along the circumferential direction, and thus it is possible to achieve the above effect to suppress a recirculation flow while achieving a smooth flow in the scroll flow passage to suppress an increase in pressure loss.

(8) In some embodiments, in the centrifugal compressor described in any one of the above (1) to (6), an outer peripheral edge of the first diffuser portion has a curved concave shape curved so as to recess inward in a radial direction of the impeller.

With the above centrifugal compressor (8), the outer radius R1 of the first diffuser portion can be easily reduced in a relatively small area in the vicinity of the angular position of the tongue section, and thus it is possible to suppress a recirculation flow effectively.

(9) In some embodiments, in the centrifugal compressor described in any one of the above (1) to (7), the outer radius R1 of the first diffuser portion in the first angular range is at its minimum in an angular range of from minus 15 to 15 degrees, provided that the angular position of the tongue section is zero degree.

With the above centrifugal compressor (9), the outer radius R1 of the first diffuser portion is at its minimum at the angular position of the tongue section of the scroll flow passage or an angular position in the vicinity thereof, and thereby it is possible to suppress deflection of the diffuser outlet flow to the region on the radially outer side at the scroll start of the scroll flow passage effectively. Accordingly, it is possible to suppress generation of the recirculation flow effectively.

(10) A turbocharger according to at least one embodiment of the present invention includes the centrifugal compressor according to any one of the above (1) to (9).

The above turbocharger (10) includes the centrifugal compressor according to any one of the above (1) to (9) capable of improving the compressor performance by suppressing occurrence of a recirculation, and thus it is possible to provide a high-performance turbocharger.

Advantageous Effects

According to at least one embodiment of the present invention, provided is a centrifugal compressor and a turbocharger having the same, capable of improving the compressor performance by reducing the loss that accompanies a recirculation flow.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
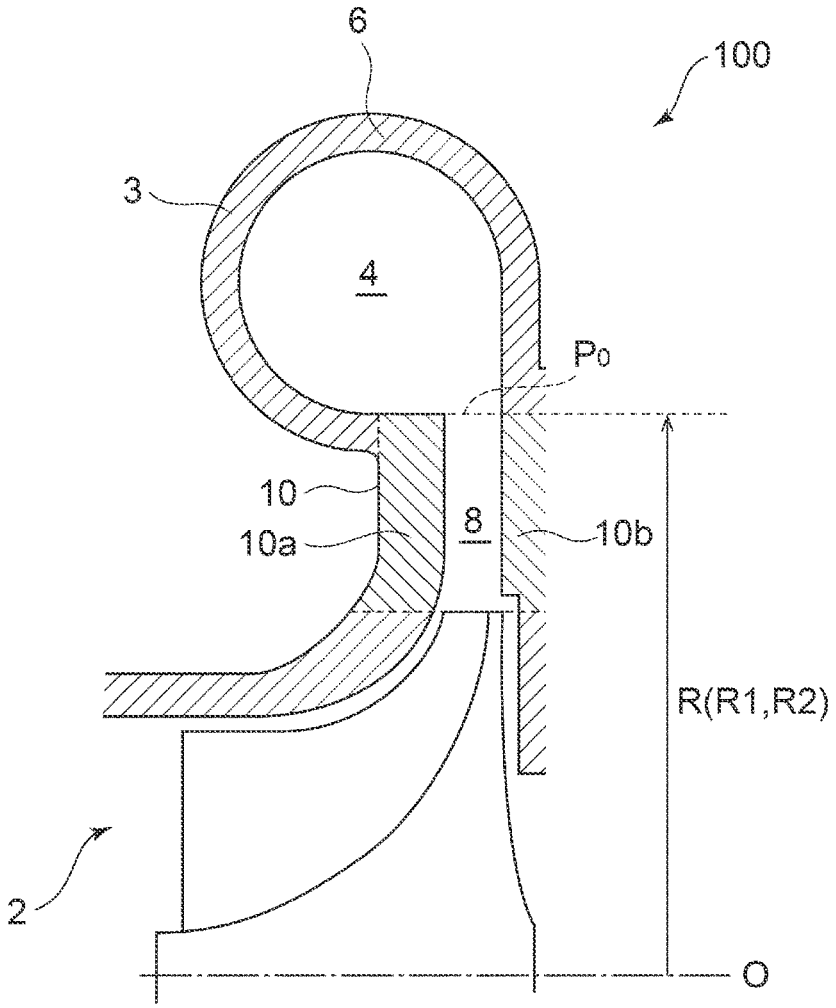
FIG. 1 is a schematic cross-sectional view of a centrifugal compressor 100 according to an embodiment, taken along the axial direction of the compressor 100.
Figure 2:
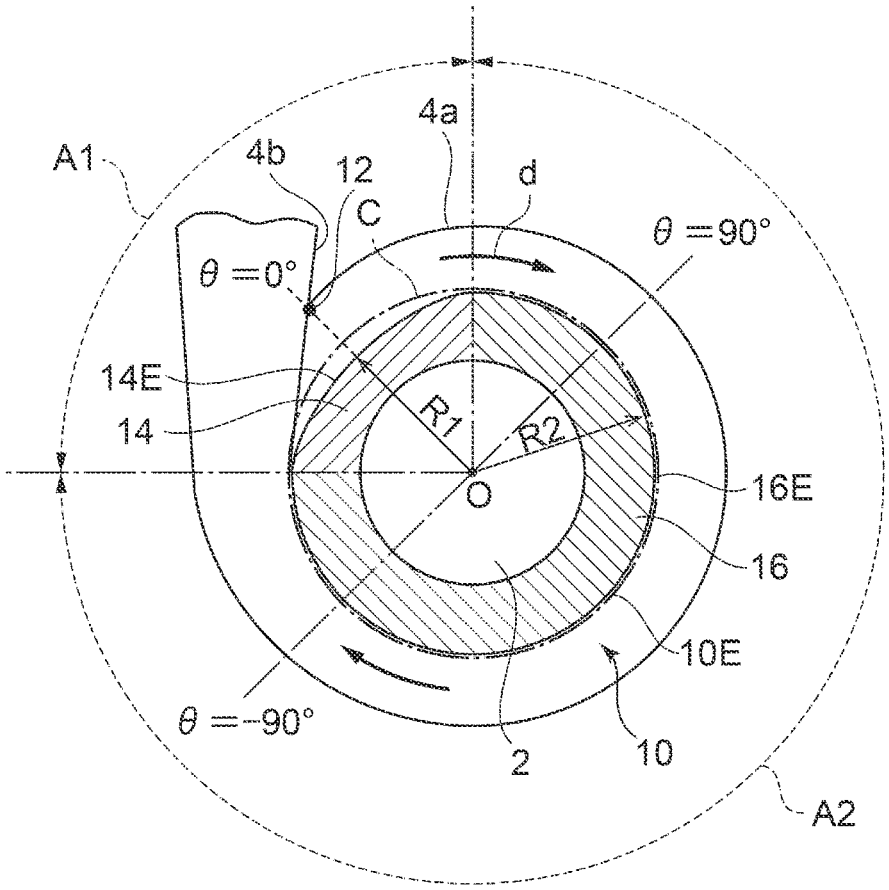
FIG. 2 is a schematic diagram of an example of a cross-section perpendicular to the axial direction of the centrifugal compressor 100 shown in FIG. 1.
Figure 3:
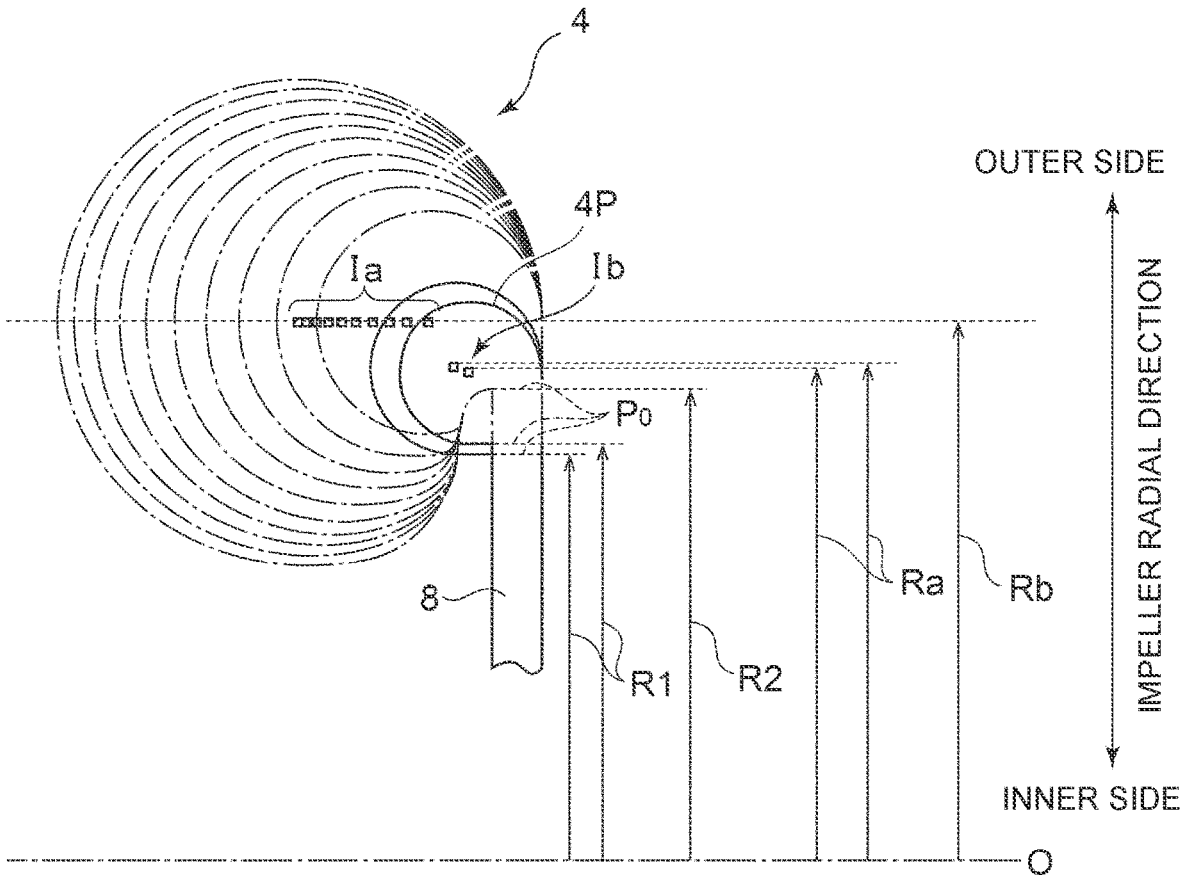
FIG. 3 is a diagram showing the shape change of the scroll flow passage 4 at each predetermined angle in the circumferential direction of the centrifugal compressor 100 shown in FIG. 2.

FIG. 1 is a schematic cross-sectional view of a centrifugal compressor 100 according to an embodiment, taken along the axial direction of the compressor 100. FIG. 2 is a schematic diagram of an example of a cross-section perpendicular to the axial direction of the centrifugal compressor 100 shown in FIG. 1. FIG. 3 is a diagram showing the shape change of the scroll flow passage 4 at each predetermined angle in the circumferential direction of the centrifugal compressor 100 shown in FIG. 2. The centrifugal compressor 100 can be applied to turbochargers for automobiles or ships, or other industrial centrifugal compressors and blowers, for instance.

For instance, as shown in FIG. 1, the centrifugal compressor 100 includes an impeller 2 and a casing 3. The casing 3 includes a scroll part 6 forming a scroll flow passage 4 on the outer peripheral side of the impeller 2, and a diffuser part 10 forming a diffuser flow passage 8 for supplying the scroll flow passage 4 with compressed air compressed by the impeller 2. In the cross section along the axial direction of the impeller 2, the scroll flow passage 4 has a circular shape, and the diffuser flow passage 8 is formed to have a linear shape. The diffuser part 10 includes a pair of flow-passage walls 10*a*, 10*b* disposed on both sides of the diffuser flow passage 8 in the axial direction of the impeller 2. In FIG. 1, the scroll part 6 and the diffuser part 10 are shaded with different kinds of hatching for convenience. Nevertheless, the casing 3 may include a plurality of casing parts connected via joints which may not necessarily be the boundary position between the scroll part 6 and the diffuser part 10. Furthermore, the casing 3 may include a part of a bearing housing which accommodates a bearing rotatably supporting the impeller 2, besides a compressor housing which accommodates the impeller 2. As shown in FIG. 3, the cross-sectional area of the scroll flow passage 4 increases downstream in the circumferential direction from the flow-passage cross section 4P corresponding to the angular position of the tongue section 12 (joint position between the scroll start 4*a* and the scroll end 4*b* of the scroll flow passage 4 in the scroll part 6).

For instance, as shown in FIG. 2, the diffuser part 10 includes: a first diffuser portion 14 belonging to the first angular range A1 including the angular position of the tongue section 12 of the scroll part 6, of the angular range in the circumferential direction of the impeller 2; and a second portion 16 belonging to the second angular range A2 downstream of and adjacent to the first angular range A1 in the flow direction 'd' of the scroll flow passage 4, of the angular range in the circumferential direction of the impeller 2, the second diffuser portion 16 having an outer radius R2 which is defined along the reference circle C centered at the rotational center O of the impeller 2.

For instance, as shown in FIG. 2, the outer radius R1 of the first diffuser portion 14 in the first angular range A1 is smaller than the outer radius R2 of the second diffuser portion 16 in the second angular range A2. That is, the distance R1 between the outlet position Po (see FIG. 1) of the diffuser flow passage 8 in the first angular range A1 and the rotational center O of the impeller 2 is smaller than the distance R2 between the outlet position Po (see FIG. 1) of the diffuser flow passage 8 in the second angular range A2 and the rotational center O of the impeller 2.

Figure 4:
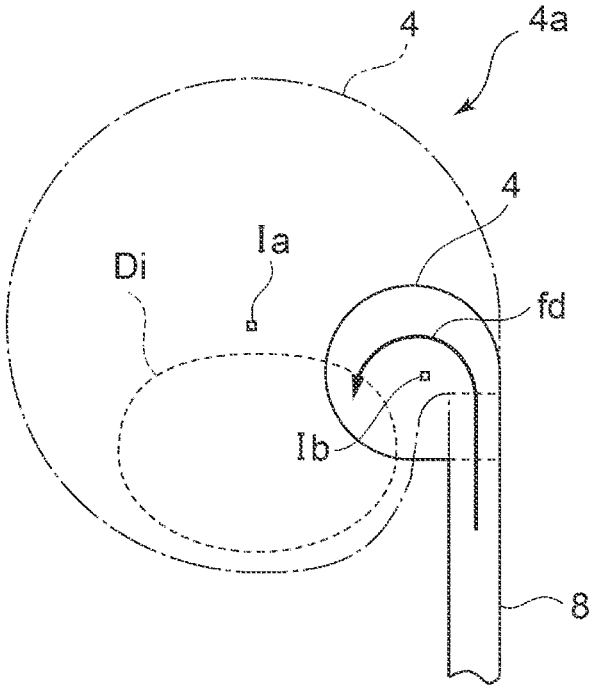
FIG. 4 is a diagram for describing how a diffuser outlet flow 'fd' is guided to a region Di on the radially inner side of the flow-passage cross section on the downstream side.

With the above configuration, as shown in FIG. 3, it is possible to achieve easily a configuration in which the distance Ra between the centroid Ia of the flow-passage cross section (flow-passage cross section shown by solid line in FIG. 3) of the scroll flow passage 4 in the first angular range A1 and the rotational center O of the impeller 2 is smaller than the distance Rb between the centroid Ib of the flow-passage cross section (flow-passage cross section shown by single dotted chain line in FIG. 3) of the scroll flow passage 4 in the second angular range A2 and the rotational center O of the impeller. That is, it is possible to easily shift the flow-passage cross section of the scroll flow passage 4 in the first angular range A1 from the flow-passage cross section of the scroll flow passage 4 in the second angular range A2, in the radial direction of the impeller 2. Thus, as shown in FIG. 4, it is possible to facilitate introduction of the diffuser outlet flow 'fd' that flows from the diffuser flow passage 8 to the scroll flow passage 4 in the first angular range A1 to the region Di on the radially inner side (inner side in the radial direction) of the flow-passage cross section on the downstream side (flow-passage cross section shown by single dotted chain line).

Figure 5:
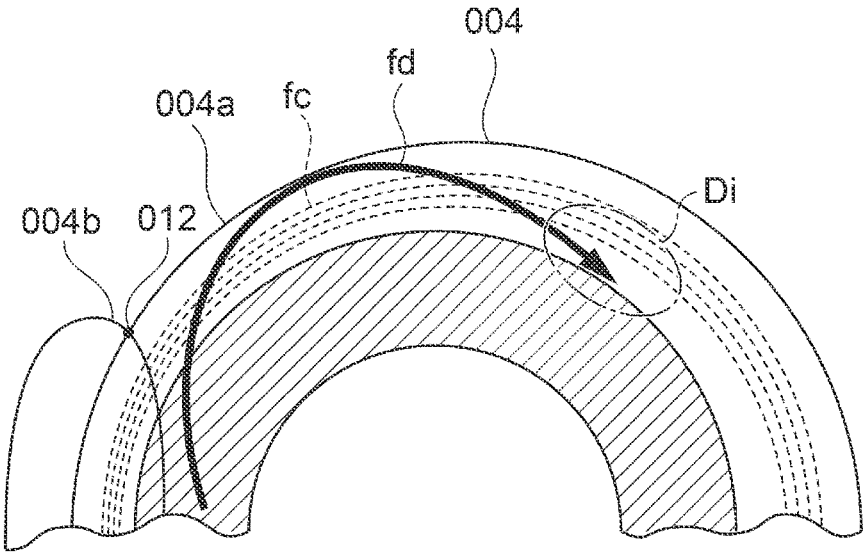
FIG. 5 is a diagram for describing the path of the fluid fd in a comparative embodiment.
Figure 6:
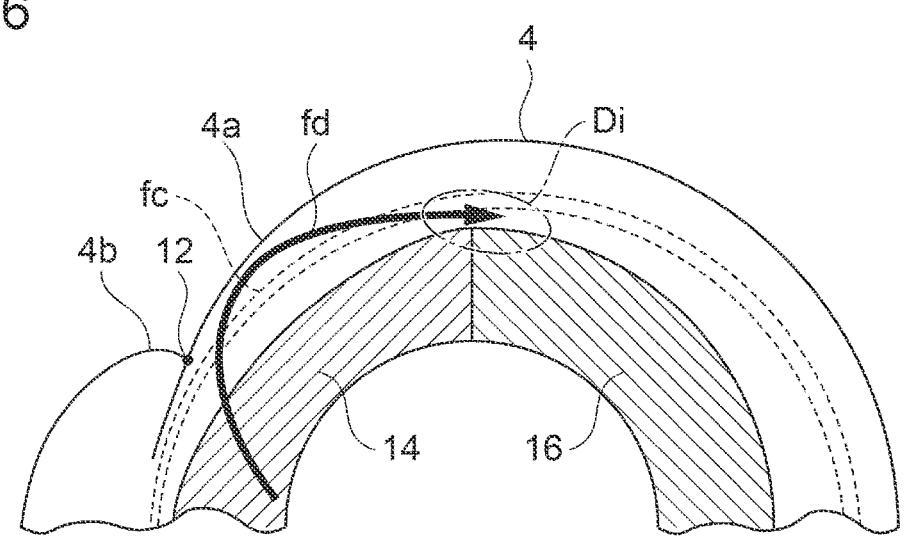
FIG. 6 is a diagram for describing the path of the fluid fd in an embodiment.
Figure 10:
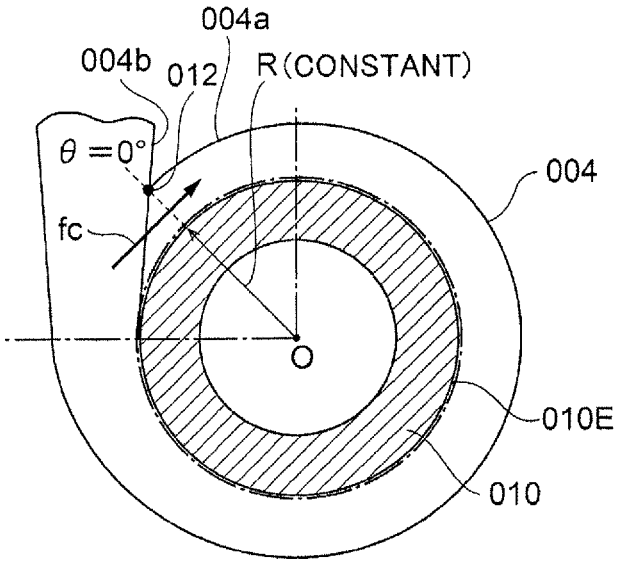
FIG. 10 is a schematic diagram of a cross-section perpendicular to the axial direction of a centrifugal compressor according to a comparative embodiment.
Figure 11:
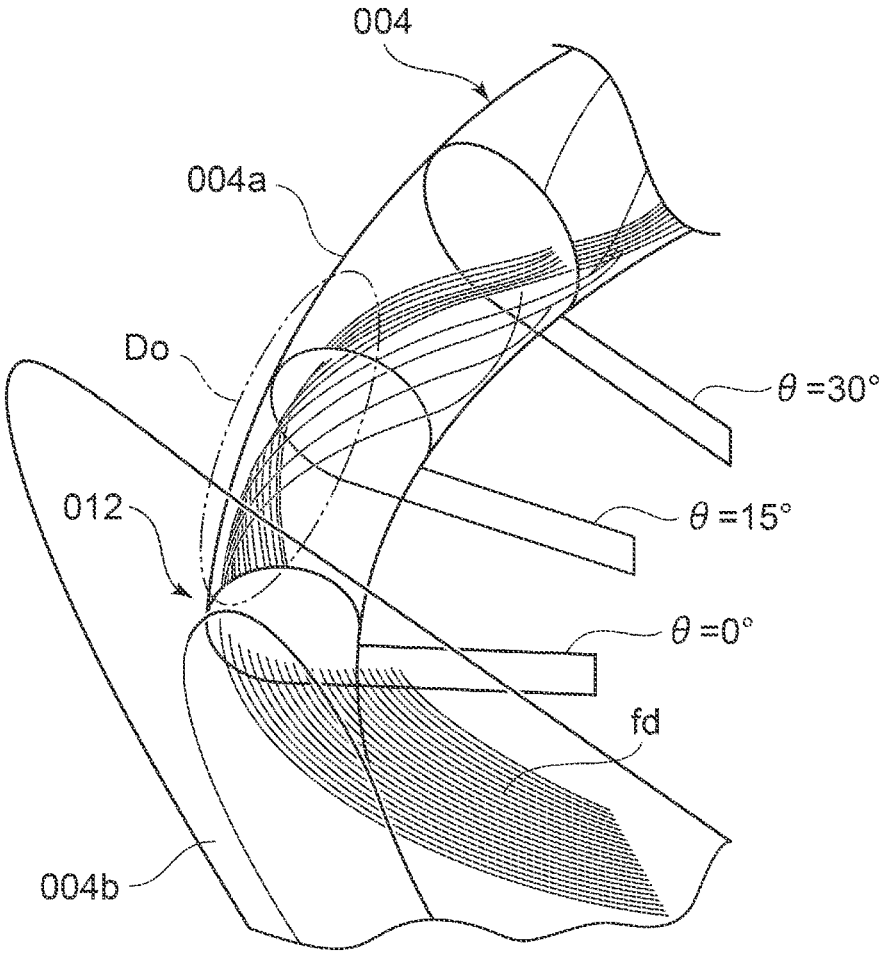
FIG. 11 is a flow line diagram of the diffuser outlet flow 'fd', showing how the flow 'fd' from the diffuser outlet forms a swirl flow along the flow passage wall of the scroll flow passage 004.
Figure 12A:
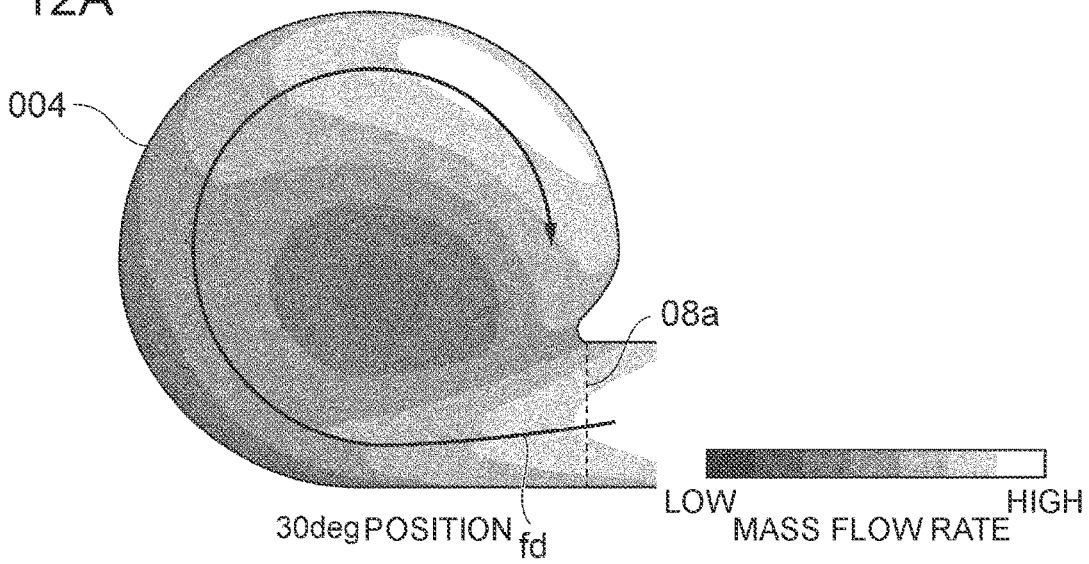
FIG. 12A is a diagram showing the distribution of the mass flow rate of the diffuser outlet flow 'fd', in a flow-passage cross section of the scroll flow passage 004 at the angular position θ=0° (tongue section position) shown in FIG. 11.
Figure 12B:
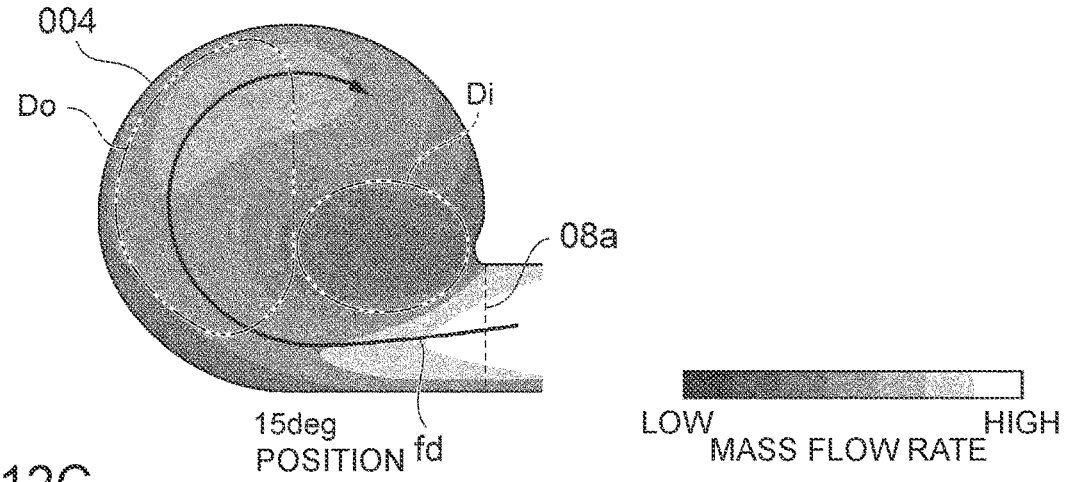
FIG. 12B is a diagram showing the distribution of the mass flow rate of the diffuser outlet flow 'fd', in a flow-passage cross section of the scroll flow passage 004 at the angular position θ=15° shown in FIG. 11.
Figure 12C:
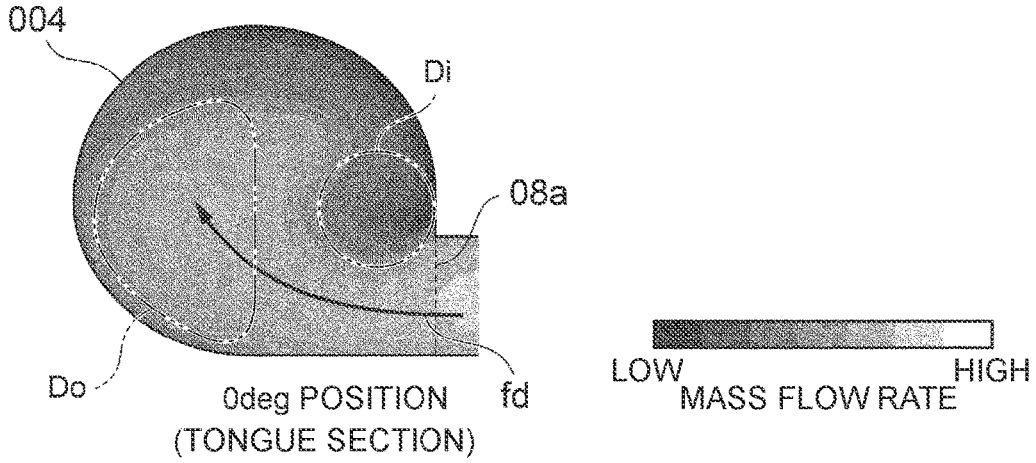
FIG. 12C is a diagram showing the distribution of the mass flow rate of the diffuser outlet flow 'fd', in a flow-passage cross section of the scroll flow passage 004 at the angular position θ=30° shown in FIG. 11.
Figure 13:
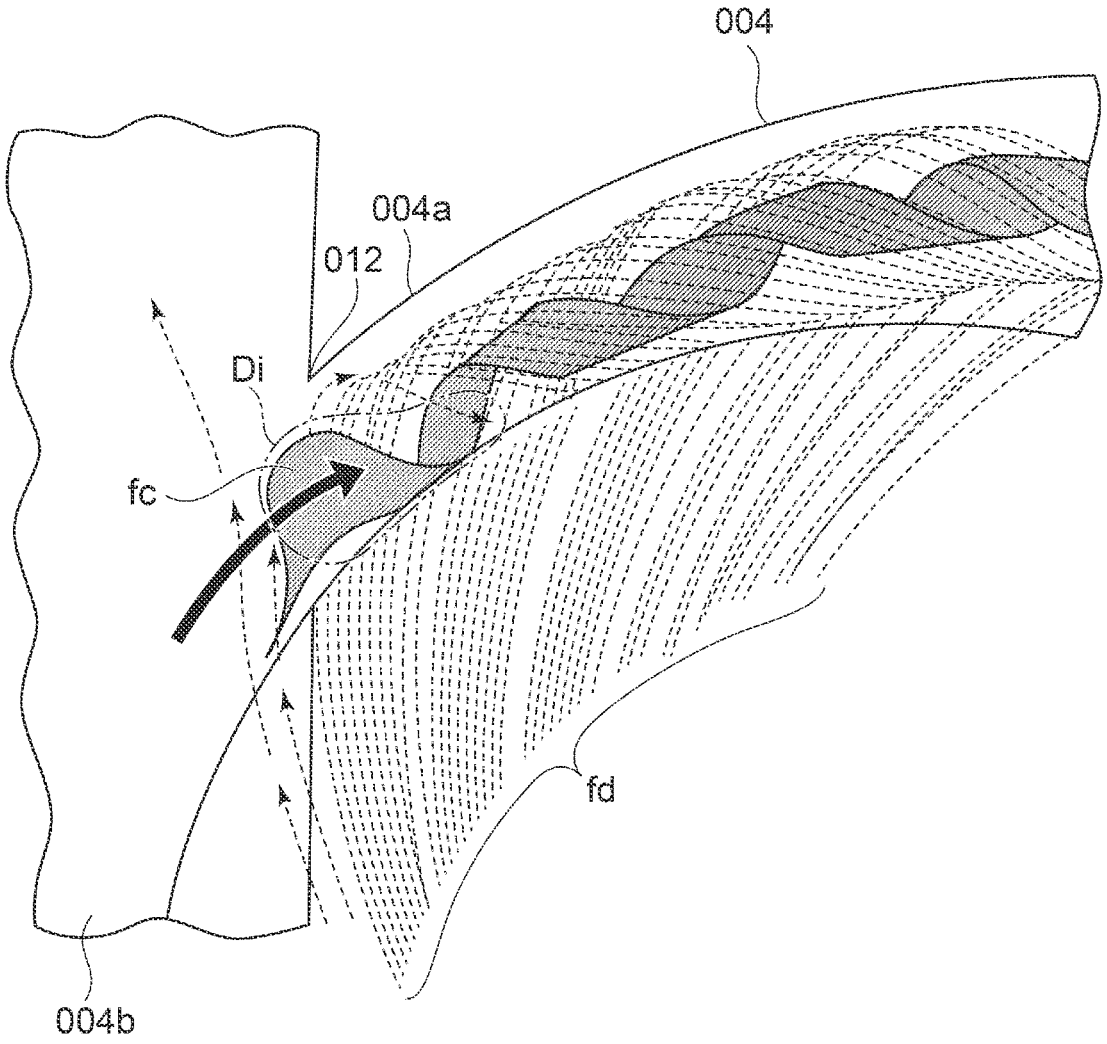
FIG. 13 is a flow line diagram for describing the relationship between the diffuser outlet flow 'fd' and the recirculation flow 'fc' in the scroll flow passage 004.

Accordingly, compared to the comparative embodiment shown in FIG. 10 (centrifugal compressor in which the outer peripheral edge 010E of the diffuser part 010 has a circular shape in the axial directional view and the outer radius R of the diffuser part 010 is constant regardless of the circumferential directional position), as shown in FIGS. 5 and 6, it is possible to easily position the angular position where the diffuser outlet flow 'fd' arrives at the region Di on the radially inner side in the flow-passage cross section at the scroll start 4*a* in the vicinity of the tongue section 12 of the scroll flow passage 4 (angular position where the mass flow rate of the diffuser outlet flow 'fd' in the region Di on the radially inner side reaches some level) closer to the angular position of the tongue section 12. Accordingly, it is possible to effectively suppress deflection of the diffuser outlet flow 'fd' to the region Do on the radially outer side at the scroll start 4*a* of the scroll flow passage 4, which is the technical problem described above with reference to FIGS. 10 and 12A to 12C.

Thus, compared to the above comparative embodiment, it is more difficult for the recirculation flow 'fc' to enter the region Di on the radially inner side in the scroll flow passage 4, and thereby it is possible to suppress generation of the recirculation flow 'fc' and to suppress generation of loss that accompanies the recirculation flow 'fc'. Furthermore, since generation of the recirculation flow 'fc' is suppressed, it is possible to reduce the flow-passage cross-sectional area of the scroll flow passage 4 required, and to reduce the size of the scroll part 6.

It is known that the recirculation flow has low energy and tends to accumulate at the center of the cross section of the scroll flow passage 4, and at occurrence of surge that limits the operational limit of the compressor at a low air flow side, a reverse flow occurs from the center part of the scroll cross section where the low energy fluid is accumulated. In this regard, with the above embodiment, the outer radius R1 of the first diffuser portion 14 is smaller than the outer radius R2 of the second diffuser portion 16, and thereby generation of the recirculation flow is suppressed, which makes it possible to make the energy distribution uniform in the cross section of the scroll flow passage 4 and to bring about improvement of the surge characteristics (achievement of a wider range).

In an embodiment, as shown in FIG. 3, the distance between the centroid Ib of the flow-passage cross section of the scroll flow passage 4 in the second angular range A2 and the rotational center O of the impeller may be constant regardless of the angular range in the circumferential direction of the impeller 2.

Figure 7:
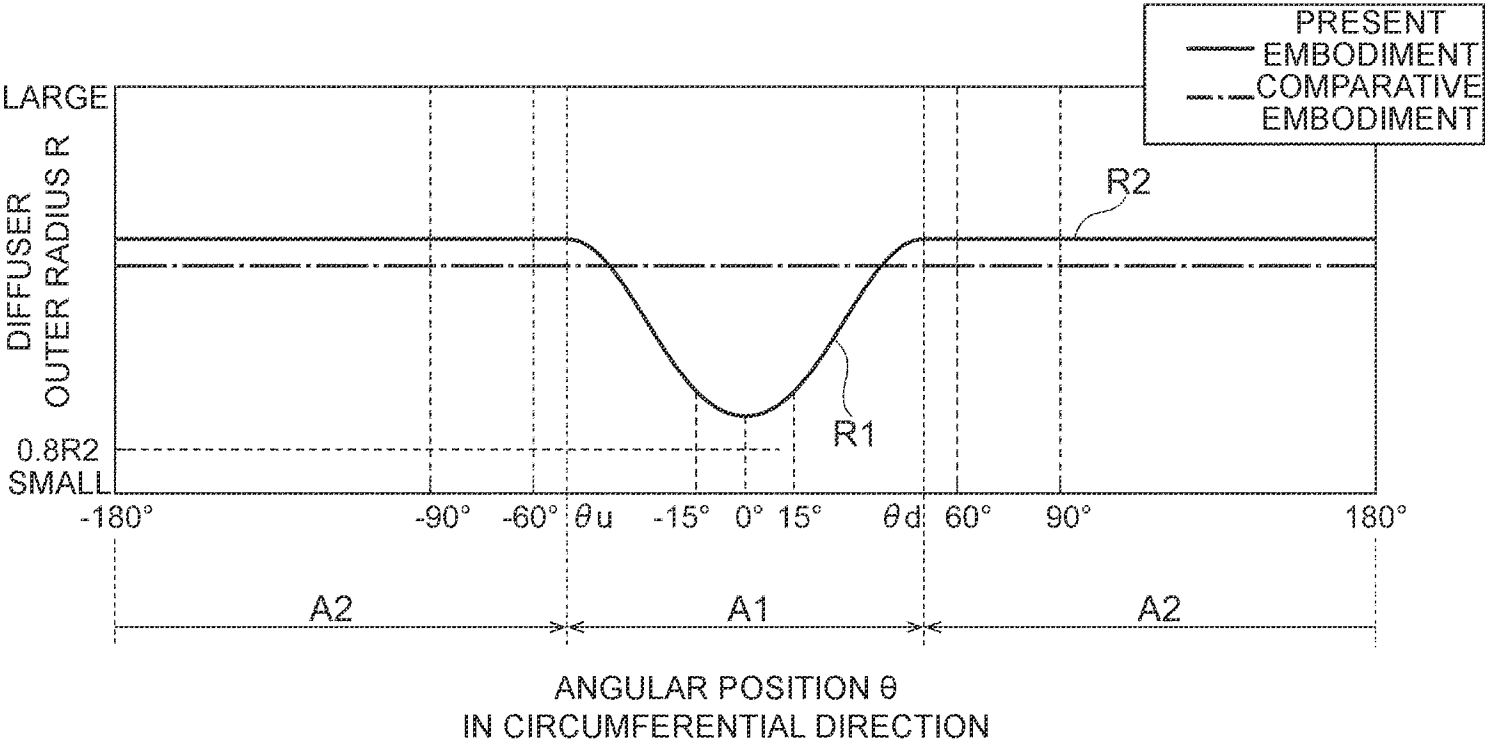
FIG. 7 is a diagram showing the relationship between the angular position in the circumferential direction of the centrifugal compressor 100 shown in FIG. 2 and the outer radius R of the diffuser part 10 (outer radius R1 of the first diffuser portion 14 and the outer radius R2 of the second diffuser portion 16).

FIG. 7 is a diagram showing the relationship between the angular position in the circumferential direction of the centrifugal compressor 100 shown in FIG. 2 and the outer radius R of the diffuser part 10 (outer radius R1 of the first diffuser portion 14 and the outer radius R2 of the second diffuser portion 16).

In an embodiment, as shown in FIG. 7 for instance, the outer radius R1 of the first diffuser portion 14 in the first angular range A1 may be at its minimum in the angular range from minus 15 to 15 degrees (more preferably, from minus 10 to 10, or even more preferably, from minus 5 to 5), provided that the angular position of the tongue section 12 is zero degree. In the example shown in FIG. 7, the outer radius R1 of the first diffuser portion 14 decreases toward the downstream side from a predetermined angular position θu upstream of the zero degree position, reaches its minimum in the vicinity of the zero degree angular position of the tongue section 12, and increases toward a predetermined angular position θd on the further downstream side. In the second angular range A2 on the downstream side of the predetermined angular position θd, the outer radius R2 of the second diffuser portion 16 is constant.

Accordingly, the outer radius R1 of the first diffuser portion 14 is at its minimum at the angular position of the tongue section 12 of the scroll flow passage 4 or an angular position in the vicinity thereof, it is possible to suppress deflection of the diffuser outlet flow 'fd' to the region on the radially outer side at the scroll start 4*a* of the scroll flow passage 4 effectively. Accordingly, it is possible to suppress generation of the recirculation flow effectively.

In an embodiment, as shown in FIG. 7 for instance, the outer radius R1 of the first diffuser portion 14 at the angular position (zero degree) of the tongue section 12 in the circumferential direction of the impeller 2 and the outer radius R2 of the second diffuser portion 16 in the second angular range A2 may satisfy $0.8R2<R1<R2$.

Generally, when the outer radius of the diffuser portion is reduced (when the diffuser flow passage is short), the reduction amount of the flow velocity in the diffuser flow passage decreases, and the fluid enters the scroll flow passage at a relatively high flow velocity.

In this regard, with the diffuser part 10 being configured to satisfy $0.8R2<R1<R2$ as described above, it is possible to enhance the efficiency of the centrifugal compressor 100 effectively through reduction of loss that accompanies a recirculation flow, while suppressing influence of an increase in the inflow velocity of the fluid into the scroll flow passage 4 through reduction of the outer radius R1 of the first diffuser portion 14.

Figure 8:
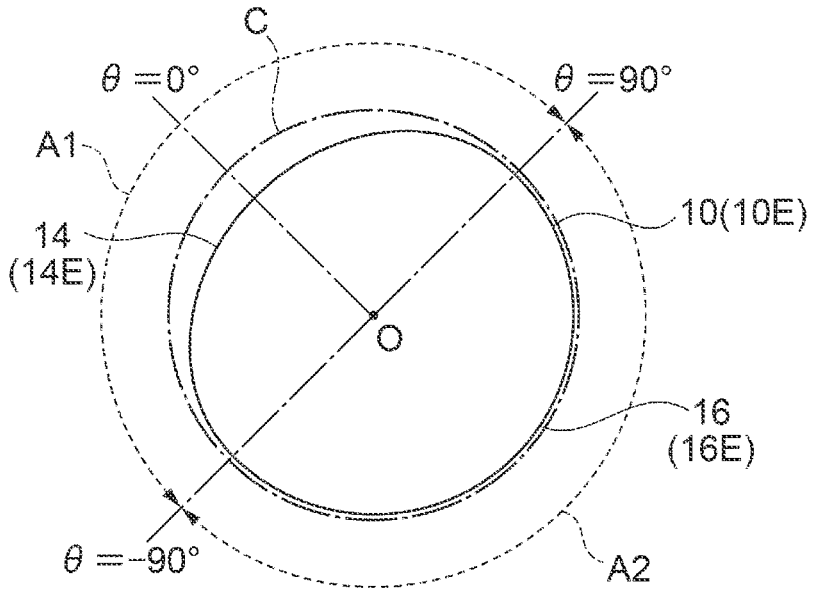
FIG. 8 is a schematic diagram showing the first modification example of the shape of the outer peripheral edge 10E of the diffuser part 10 shown in FIG. 2.
Figure 9:
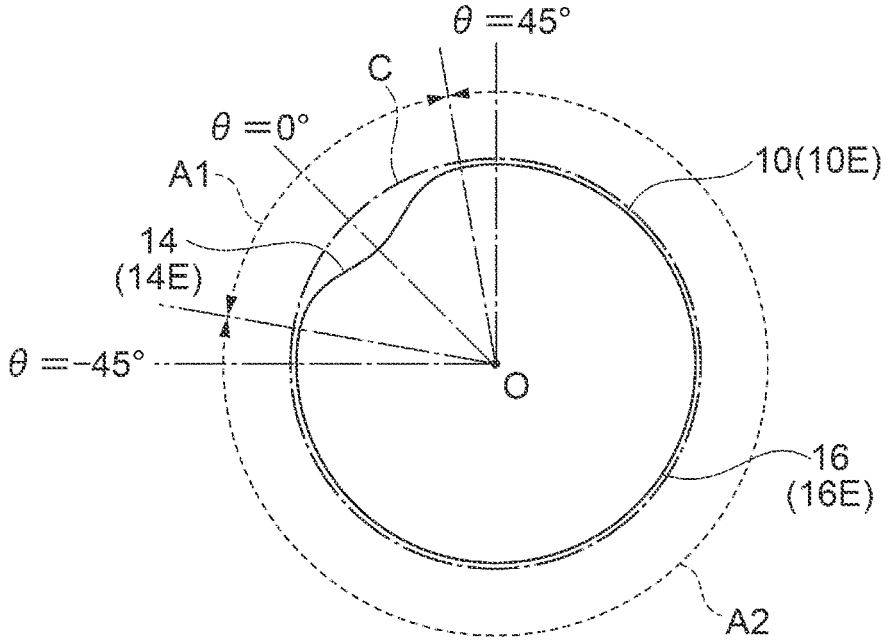
FIG. 9 is a schematic diagram showing the second modification example of the shape of the outer peripheral edge 10E of the diffuser part 10 shown in FIG. 2.

FIG. 8 is a schematic diagram showing the first modification example of the shape of the outer peripheral edge 10E of the diffuser part 10 shown in FIG. 2. FIG. 9 is a schematic diagram showing the second modification example of the shape of the outer peripheral edge 10E of the diffuser part 10 shown in FIG. 2.

In some embodiments, as shown in FIGS. 2, 8, and 9 for instance, provided that the angular position of the tongue section 12 in the circumferential direction of the impeller 2 is zero degree, the first angular range A1 may be included in the angular range from minus 90 to 90 degrees, and the second angular range A2 may be the entire angular range excluding the first angular range A1, in the circumferential direction of the impeller 2.

With the above configuration, the outer radius R1 of the first diffuser portion 14 is relatively small in the angular range in the vicinity of the tongue section 12 of the scroll flow passage 4 (from minus 90 to 90 degrees), and thereby it is possible to suppress deflection of the diffuser outlet flow 'fd' to the region on the radially outer side at the scroll start 4*a* of the scroll flow passage 4 effectively. Accordingly, it is possible to suppress generation of a recirculation flow effectively. Furthermore, the second diffuser portion 16 having the relatively large outer radius R2 is disposed over the entire angular range excluding the first angular range A1 in the circumferential direction of the impeller 2 (angular range where the outer radius of the diffuser part 10 is less likely to contribute to suppression of a recirculation flow) to give preference to recovery of pressure, and thus it is possible to reduce pressure loss in the scroll flow passage 4 effectively.

As described above, the first diffuser portion 14 having the relatively small outer radius R1 is disposed in the angular range that is likely to contribute to suppression of a recirculation flow and the second diffuser portion 16 having the relatively large outer radius R2 giving priority to pressure recovery is disposed in the angular range that is less likely to contribute to suppression of a recirculation flow, and thereby it is possible to improve efficiency of the centrifugal compressor 100 effectively.

In some embodiments, as shown in FIGS. 2 and 8, the outer peripheral edge 14E of the first diffuser portion 14 may have a curved convex shape curving so as to protrude outward in the radial direction of the impeller 2.

With this configuration, as shown in FIGS. 2 and 8, the outer radius R1 of the first diffuser portion 14 can be changed gradually along the circumferential direction, and thus it is possible to achieve the above effect to suppress a recirculation flow while achieving a smooth flow in the scroll flow passage 4 to suppress an increase in pressure loss.

In an embodiment, as shown in FIG. 9, the outer peripheral edge 14E of the first diffuser portion 14 may have a curved concave shape curving so as to recess inward in the radial direction of the impeller 2.

With the above configuration, as shown in FIG. 9, the outer radius R1 of the first diffuser portion 14 can be easily reduced in a relatively small area in the vicinity of the angular position of the tongue section 12, and thus it is possible to suppress a recirculation flow effectively.

Embodiments of the present invention were described in detail above, but the present invention is not limited thereto, and various amendments and modifications may be implemented.

DESCRIPTION OF REFERENCE NUMERALS

2 Impeller
3 Casing
4 Scroll flow passage
4*a* Scroll start
4*b* Scroll end
6 Scroll part
8 Diffuser flow passage
10 Diffuser part
10*a* Flow-passage wall
10*b* Flow-passage wall
10E Outer peripheral edge
12 Tongue section
14 First diffuser portion
14E Outer peripheral edge
16 Second diffuser portion

16E Outer peripheral edge
100 Centrifugal compressor
A1 First angular range
A2 Second angular range
C Reference circle
Di, Do Region
Ia, Ib Centroid
O Rotational center
Po Outlet position
R, R1, R2 Outer radius
Ra, Rb Distance
d Flow direction
fc Recirculation flow
fd Diffuser outlet flow

The invention claimed is:

1. A centrifugal compressor comprising an impeller and a casing, wherein the casing includes a scroll part forming a scroll flow passage on a radially outer side of the impeller and a diffuser part forming a diffuser flow passage for supplying the scroll flow passage with compressed air compressed by the impeller, wherein the diffuser part includes:

a first diffuser portion belonging to a first angular range including an angular position of a tongue section of the scroll part, of an angular range in a circumferential direction of the impeller; and a second diffuser portion belonging to a second angular range downstream of the first angular range in a flow direction of the scroll flow passage, of the angular range in the circumferential direction of the impeller, the second diffuser portion having an outer radius R2 which is defined along a reference circle centered at a rotational center of the impeller, wherein an outer radius R1 of the first diffuser portion in the first angular range is smaller than the outer radius R2 of the second diffuser portion in the second angular range, wherein the first angular range is included in an angular range of from minus 90 to 90 degrees, provided that the angular position of the tongue section in the circumferential direction of the impeller is zero degree, wherein the second angular range is an entire angular range in the circumferential direction of the impeller excluding the first angular range, wherein an outer peripheral edge of the first diffuser portion has a curved concave shape curved so as to recess inward in a radial direction of the impeller, and wherein the outer radius R1 of the first diffuser portion in the first angular range is at its minimum in a range of the curved concave shape.

2. The centrifugal compressor according to claim 1, wherein the scroll part is configured such that a distance Ra between the rotational center of the impeller and a centroid of a flow-passage cross section of the scroll flow passage in the first angular range is smaller than a distance Rb between the rotational center of the impeller and a centroid of a flow-passage cross section of the scroll flow passage in the second angular range.

3. The centrifugal compressor according to claim 1, wherein the outer radius R1 of the first diffuser portion at the angular position of the tongue section in the circumferential direction of the impeller and the outer radius R2 of the second diffuser portion in the second angular range satisfy $0.8R2<R1<R2$.

4. The centrifugal compressor according to claim 1, wherein the first angular range is included in an angular range of from minus 45 to 45 degrees.

5. The centrifugal compressor according to claim 1, wherein the outer radius R1 of the first diffuser portion in the first angular range is at its minimum in an angular range of from minus 15 to 15 degrees, provided that the angular position of the tongue section is zero degree.

6. A turbocharger including a turbine and the centrifugal compressor according to claim 1.

* * * * *